United States Patent [19]

Manber

[11] 3,958,409

[45] May 25, 1976

[54] WATCH DISPLAY

[76] Inventor: Solomon Manber, Hoffstats Lane, Sands Point, N.Y. 11050

[22] Filed: Sept. 12, 1974

[21] Appl. No.: 505,473

[52] U.S. Cl. ..... 58/50 R; 58/127 R
[51] Int. Cl.[2] ..... G04B 19/24; G04B 19/06
[58] Field of Search ..... 58/50 R, 127 R

[56] References Cited

UNITED STATES PATENTS

| | | | |
|---|---|---|---|
| 3,574,992 | 4/1971 | Ladas | 58/127 X |
| 3,754,392 | 8/1973 | Daniels | 58/127 R X |
| 3,757,511 | 9/1973 | Burgess et al. | 58/50 R |
| 3,802,182 | 4/1974 | Fujita | 58/50 R |
| 3,839,857 | 10/1974 | Berets et al. | 58/127 R X |

*Primary Examiner*—Edith Simmons Jackmon
*Attorney, Agent, or Firm*—Hane, Baxley & Spiecens

[57] ABSTRACT

A watch display includes first and second concentric circular arrays of light emitting diodes which are sequentially energized to indicate the minutes and hours such that only one diode from each array is energized at any one time.

9 Claims, 4 Drawing Figures

FIG. 1
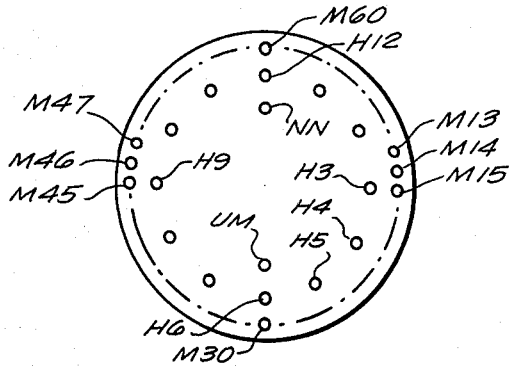
FIG. 2
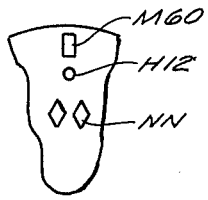
FIG. 3
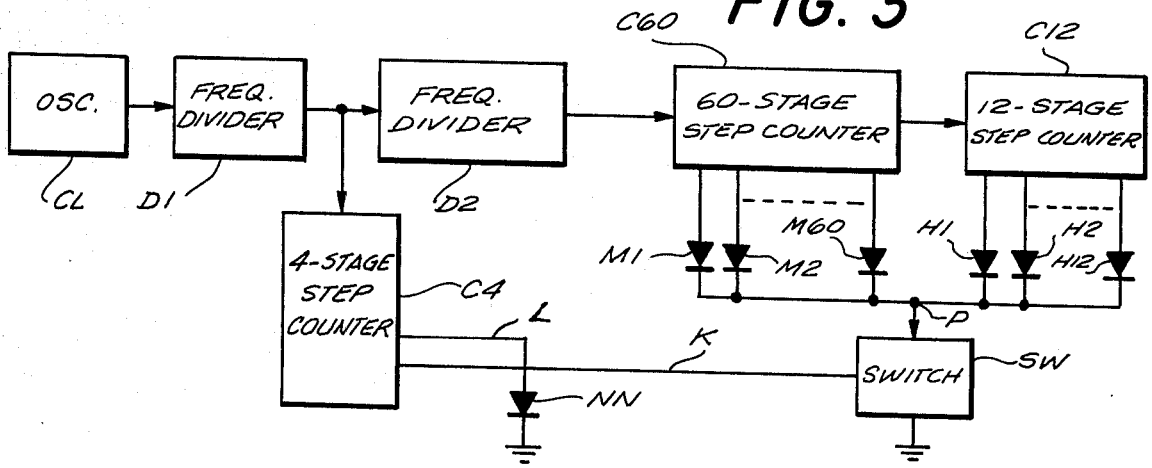
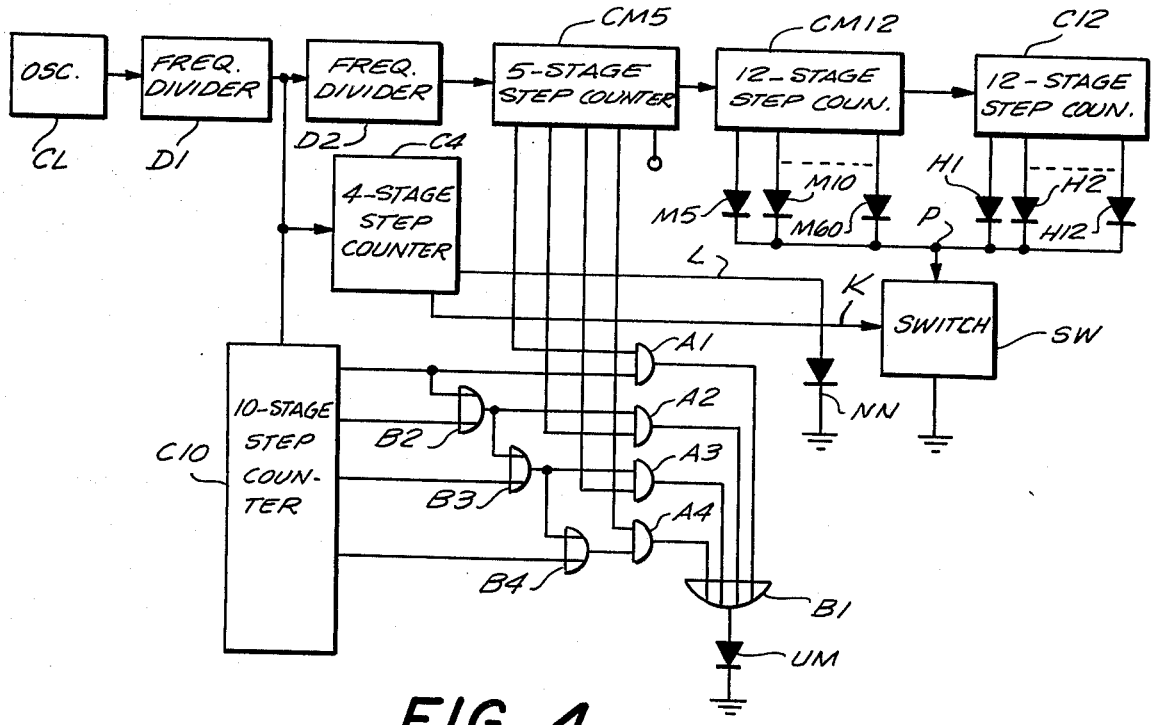
FIG. 4

WATCH DISPLAY

This invention pertains to watch displays.

Within the past few years because of advances in the large scale integration of electronic devices, it has become possible to make an all electronic wrist watch driven from a small battery having a lifetime of a year. While it is true that the oscillator and frequency dividing circuits are so designed to cause a minimum drain on the battery, the display means still have many drawbacks. The two usual display means display in numeric form the time. The first utilizes liquid crystals which are low power consuming devices. While liquid crystal displays can continuously display the time, they rely on the reflection of ambient light. Consequently, in low ambient light or from light arriving in non-preferred directions, it is difficult to display the time. In addition, the liquid crystals are temperature sensitive and their useful life has not been satisfactorily determined.

The second uses light-emitting-diode bar generators. Such devices do not rely on ambient light but generate their own light in bar segments which are used in combinations to form numerals. Because of the power consumption associated with such devices, continuous displays are impractical for wrist watches. Accordingly, the display is normally not energized and a push button is provided. When a user wishes to know the time he pushes the button to energize the display. While this technique solves both the power consumption problem and the need for ambient light, it is inconvenient because it requires the use of the "other" hand of the user to activate the display.

It is accordingly a general object of the invention to provide a display for a watch which has none of the drawbacks of presently available displays.

Generally, the invention contemplates a display apparatus for a watch wherein an oscillator generates clock pulses which are counted down to signals representing minutes and signals representing hours. The display comprises a first series of light emitting diode means wherein each diode means is associated with a different specific minute of at least some of the 60 minutes in an hour and a second series of light emitting diode means wherein each of the diode means of the second series is associated with at least one and no more than two specific hours in a day. There are provided means for receiving the counted down signals for sequentially energizing the diode means of the first series one at a time and for sequentially energizing the diode means of the second series one at a time.

It should be apparent that since at any one time only two of the diode means are energized there is a considerable cutting down of the power drain.

In addition, according to a feature of the invention the energized diode means are effectively pulsed so as to further cut down on the power consumption.

When using the light emitting diode means of the invention the small point source lighting that is generated can give the appearance on the face of the watch of tiny jewels such as rubies and sapphires in accordance with the color of the light emitted by the diode means.

Other objects, the features and advantages of the invention will be apparent from the following detailed description when read in conjunction with the accompanying drawing wherein:

FIG. 1 shows the face of a watch utilizing the invention;

FIG. 2 is an enlarged fragmentary view of a portion of the watch face of FIG. 1;

FIG. 3 is a schematic diagram of the circuitry for a watch according to one embodiment of the invention; and FIG. 4 is a schematic diagram of the circuitry according to another embodiment of the invention.

In FIG. 1 the watch face is shown having 60 light-emitting minute-diodes M1 to M60 disposed about the circular periphery of watch W, 12 light-emitting hour-diodes H1 to H12 disposed about a circle concentric to the circular periphery, and one light-emitting noon diode NN. In order to further distinguish the hour, minute and noon diodes from each other, different colors can be used.

For example red for minutes, green for hours and orange or blue for noon. Alternatively the diodes could all be one color but disposed behind masks having different shapes as shown in FIG. 2.

In operation, the noon diode NN would always be energized to give a reference orientation for viewing, while only 1 minute diode and 1 hour diode would be energized at any one time. The selective energization of these diodes can be accomplished by the circuitry shown in FIG. 3. In particular, a high frequency quartz oscillator CL generates pulses that are frequency divided by frequency divider D1 to a rate of say one pulse per second which are in turn divided down to one pulse per minute by frequency divider D2. The output of frequency divider D2 is connected to the input of 60-stage step counter C60 whose output is connected to 12-stage step counter C12. Both counters are identical except for the number of stages. In particular, each counter has the property that when empty of receiving a pulse at its input and for shifting that pulse downstream one stage for each subsequent pulse received at its input until the pulse is shifted out of the last stage and then to repeat the cycle. Thus, it is seen that if the pulses from frequency divider D2 occur at a rate of 1 per minute each stage of counter C60 will hold the pulse for 1 minute before it is shifted. It follows that a pulse received at the input of counter C60 will be transferred from the output of counter C60 1 hour later to the input counter C12 since counter C60 is a 60 stage counter. In a like manner 12 stage counter C12 will hold a pulse in any of its 12 stages 1 hour before shifting it downstream to the next succeeding stage.

The output of each stage of counter C60 is connected to the anode of one of the minute light-emitting diodes M1 to M60 respectively while the output of each of the stages of counter C12 is connected to one of the anodes of the hour light-emitting diodes H1 to H12 with the cathodes of all diodes connected to point P. If one assumes, for the minute, that point P is grounded and that when a pulse is in the stage of a counter the counter output is high, then a current flows from the stage through the diode of sufficient amplitude to cause the diode to emit light. In this way at any instant of time 1 hour and 1 minute diodes are energized to indicate the time.

However, to further minimize power consumption point P can be connected via the collector-emitter circuit of a transistor to ground. The transistor can be a specific version of switch SW having a control input (the base terminal of the transistor) which closes the switch whenever a high signal is received at the control input connected to line K. A four-stage step counter C4 (similar to the counters C12 and C60) connects the output of frequency divider D1 to line K. In particular, the input of counter C4 is connected to the output of divider D1 while the fourth stage output of the counter C4 is connected to line K. In this way line K is only high one fourth of the time. Consequently, switch SW is closed only one fourth of the time. Therefore, each of the minute and hour diodes will be energized only one fourth of the time. It should be noted that noon diode NN is connected between ground and line (K) L, connected to the third stage output of the counter and will therefore, be "continuously" energized at one quarter duty cycle.

It should also be noted that one can vary the duty cycle by increasing or decreasing the number of stages in Counter C4. In addition one can vary the absolute on-time of a diode by changing the repetition rate of the pulses fed to counter C4. This control gives the designer the opportunity to cause the particular diodes to appear continuously on when energized by using pulses of such frequencies, durations and duty cycles so that the persistence of the eye cannot resolve the pulsations, or to appear as twinkling when energized by using pulses of lower frequencies.

Furthermore, it should be realized that although only 12 hour diodes have been shown, this does not preclude the use of 24 hour diodes. In addition, although 60 minute diodes have been disclosed, it is possible to use, say, 12 such diodes to divide the hour up into 5 minute increments and to use the modulo-five blinking of the appropriate 5-minute diode or a supplementary diode such as the noon diode or a further diode to give the number of minutes in each 5 minute increment.

FIG. 4 shows an embodiment using twelve 5-minute diodes, i.e., diodes positioned at the 5 minute (or hour) points on the face of a watch. In FIG. 1 the watch would then have diodes H1 to H12, NN, UM and M5, M10, M15 . . . , M55 and M60. Since the circuitry of FIG. 4 is in many ways the same as the circuitry of FIG. 3 like reference characters will be used for the same elements and only the differences will be discussed. In particular, 60-stage step counter C60 is replaced five-stage step counter CM5 and 12 stage step counter CM12 connected in cascade between frequency divider D2 and counter C12. The output of each of the 12 stages of counter CM12 is connected to anodes of diodes M5, M10, M15 . . . . M55 and M60 whose cathodes are connected to point P. Since counter CM5 is a five stage step counter driven by minute pulses from frequency divider D2, counter CM5 emits a pulse once every 5 minutes to counter CM12 which therefore steps once every 5 minutes. Accordingly, the diodes M5, etc. connected to the outputs of the stages of counter CM12 are sequentially energized for 5 minute intervals. Thus, the embodiment as described up until now can display time with a precision of 5 minutes. The remaining circuitry is used to indicate time at 1 minute intervals. This is accomplished by pulsing light emitting diode UM connected between ground and the output of four-input OR-circuit B1. The inputs of OR-circuit B1 are connected to the outputs of the four two-input AND-circuits A1, A2, A3 and A4. A first input of each AND-circuit is connected to the corresponding number stage counter CM5, e.g., an input of AND-circuit A1 is connected to the output of the first stage of counter CM5. Thus, AND-circuit A1 will be alerted every first, sixth . . . $5n + 1$ minute in an hour, AND-circuit A2 will be alerted every second, seventh, . . . $5n + 2$ minute in an hour, etc.

The second input of AND-circuit A1 is connected to the output of the first stage of 10-stage step counter C10 (similar to all previously described step counters) which is stepped each second by pulses from frequency divider D1. Thus, once per 10 seconds, the second input of AND-circuit A1 will receive a 1-second pulse.

The second input of AND-circuit A2 is connected to the output of two-input OR-circuit B2 whose inputs are connected to outputs of the first and second stages of counter C10. Thus, once per 10 seconds, the second input of AND-circuit A2 receives two 1-second pulses. The second input of AND-circuit A3 is connected to the output of two-input OR-circuit B3 whose two inputs are connected to the output of OR-circuit B2 and the output of the third stage of counter C10. Thus, once every ten seconds the second input of AND-circuit A3 receives three 1-second pulses. Similarly, the second input of AND-circuit A3 receives three 1-second pulses. Similarly, the second input of AND-circuit A4 is connected to the output of two-input OR-circuit B4 whose inputs are connected to the output of OR-circuit B3 and the output of the fourth stage of counter C10. Thus, once every 10 seconds, the second input of AND-circuit A4 receives four 1-second pulses.

The time to a minute can be given as follows: Whichever hour diode is energized indicates the hour. If a 5 minute diode such as M10 is energized and the diode UM is not pulsing the minutes are 10. If the diode UM is flashing then one need only add to 10 the number of flashes occuring in a 10 second interval. This is easy to do since in each 10 second interval there are from one to four 1-second pulses followed by at least a 6 second dead time.

It should be noted that the embodiment of FIG. 4 uses 47 less diodes as well as less electronic circuitry since the 60 stage counter is replaced by three counters totalling 27 stages, plus four AND-circuits and four OR-circuits.

What is claimed is:

1. Display apparatus for use in a watch wherein an oscillator generates clock pulses which are counted down to signals representing minutes and signals representing hours, said display apparatus comprising a first series of diode means which emit light when energized for representing hours, a second series of diode means which emit light when energized, at least some of the diode means of said second series forming a set of diode means which represent different multiples of 5 minutes, energizing means connected to said oscillator for sequentially energizing the diode means of said first series for 1 hour intervals and for sequentially energizing the diode means of said set for 5 minute intervals, and means connected to said oscillator for pulsatingly energizing one of the diode means of one of said series to indicate the number of minutes in excess of a multiple of five being represented by the watch.

2. The display apparatus of claim 1 wherein the diode means which is to be pulsatingly energized is a member of said set.

3. The display apparatus of claim 1 wherein the diode means which is to be pulsatingly energized is not a member of said set.

4. The display apparatus of claim 1 further comprising means for periodically interrupting the energization of each diode means of said first series and said set during the period of time each such diode means is being energized by said energizing means.

5. The display apparatus of claim 1 further comprising a reference diode means and means for periodically energizing said reference diode means in parallel with the energization of the diode means of said first and second series.

6. The display apparatus of claim 1 wherein the diode means of said first series are visually different from the diode means of said second series.

7. The display apparatus of claim 6 wherein the diode means of said first series emit a different color light than the diode means of said second series.

8. The display apparatus of claim 6 wherein the diode means of said first series display a different shape pattern than the diode means of said second series.

9. The display apparatus of claim 1 wherein the diode means of said first series are disposed in a first circular array and the diode means of said second series are disposed in a second circular array concentric with said first circular array.

* * * * *